US008943623B2

(12) United States Patent
Watkins

(10) Patent No.: US 8,943,623 B2
(45) Date of Patent: Feb. 3, 2015

(54) HAMMOCK WITH INTERMEDIATE SUPPORT

(71) Applicant: David R Watkins, Dover, FL (US)

(72) Inventor: David R Watkins, Dover, FL (US)

( * ) Notice: Subject to any disclaimer, the term of this patent is extended or adjusted under 35 U.S.C. 154(b) by 0 days.

(21) Appl. No.: 14/219,785

(22) Filed: Mar. 19, 2014

(65) Prior Publication Data

US 2014/0289962 A1 Oct. 2, 2014

Related U.S. Application Data

(60) Provisional application No. 61/803,267, filed on Mar. 19, 2013.

(51) Int. Cl.
*A45F 3/22* (2006.01)

(52) U.S. Cl.
USPC ..... 5/123; 5/120

(58) Field of Classification Search
USPC ..... 5/120–123, 127–130
See application file for complete search history.

(56) References Cited

U.S. PATENT DOCUMENTS

| | | | | |
|---|---|---|---|---|
| 221,754 | A | 11/1879 | Travers | |
| 330,941 | A | 11/1885 | Travers | |
| 363,096 | A | 5/1887 | Travers | |
| 355,873 | A | 6/1887 | Humphrey | |
| 664,774 | A | 12/1900 | Palmer | |
| 759,240 | A | 5/1904 | Conway | |
| 2,745,115 | A * | 5/1956 | Reiss | 5/122 |
| 4,021,868 | A | 5/1977 | Fueslein | |
| 4,320,542 | A | 3/1982 | Cohen | |
| 6,701,549 | B1 | 3/2004 | Eriksen | |
| 6,934,982 | B1 | 8/2005 | Branch, III | |
| 7,020,915 | B1 | 4/2006 | Helsdon | |
| 2011/0010849 | A1 | 1/2011 | Lemmens | |

* cited by examiner

*Primary Examiner* — Fredrick Conley
(74) *Attorney, Agent, or Firm* — Waters & Oppenhuizen PLC; David L. Oppenhuizen

(57) ABSTRACT

A hammock is supported by vertical supports connected to hammock spreader bars at the head end and the foot end of the hammock at two vertically displaced points. An intermediate support comprising a transverse flexible strap suspended between the vertical support members at a user's knee region of the hammock raises the hammock in the knee region so as to remove the concavity at the location and reduce backward knee joint stress on the person reclining in the hammock.

7 Claims, 3 Drawing Sheets

HAMMOCK WITH INTERMEDIATE SUPPORT

CROSS REFERENCE TO RELATED APPLICATION

This application claims the benefit of U.S. Provisional Application No. 61/803,267 filed Mar. 19, 2013, the entire disclosure of which is incorporated herein by reference for all purposes.

BACKGROUND OF THE INVENTION

1. Field of the Invention

The invention is related to a hammock, in particular to a hammock having end supports and an intermediate support for removing the normal concavity of the hammock and providing support at the knees of the user.

2. Description of Related Art

Hammocks are well known in the art and are used in many settings as a place of rest or respite. From their origin as a temporary or makeshift sling between two posts or trees, or between two stanchions in the bowels of a sailing ship, hammocks have come to be found in back yards everywhere. No longer relying on the happenstance of a pair of handy trees with just the right spacing, hammocks can also be found now with their own provided support base, allowing placement of a hammock anywhere.

Hammocks, however, have one common trait that has only been marginally addressed. Hammocks, by their very nature, are flexible and necessarily form a curved surface for supporting a user. The "sling" of the hammock forms a generally uniform curve, only deviating from that smooth curve as weight is added to the hammock in a non-uniform distribution. Human beings are generally non-uniform in their weight distribution and furthermore are constructed with several mono-directional joints. Those joints most affected are the hips and particularly the knees. A person lying on his back in a hammock will necessarily have an upward pressure exerted against the back of his lower calves, causing a hyperextension of the knees.

It would be desirable to provide a hammock with a construction that reduces or relieves this stress in the knee region by allowing the legs to be stretched out straight, or by lowering the foot end of the hammock so that the knees can be bent in a natural fashion.

BRIEF SUMMARY OF THE INVENTION

A hammock according to the invention is supported at the head end and at an intermediate position in the bed of the hammock, with the foot end supported separately to allow the foot end to hang at a lower position, allowing a natural resting position with the knees of the user bent and not hyperextended.

In one embodiment, the hammock has a first end and a second end, each of the first end and the second end including a transverse spreader bar and being connected to a respective generally vertical support member to suspend the hammock over a surface. The second end is preferably hung closer to the surface than the first end. The hammock further includes a supplemental support structure positioned between the first end and the second end and connected to one of the vertical support members. The supplemental support structure forms a raised portion of the hammock between the first end and the second end.

In a preferred embodiment, the supplemental support structure includes an intermediate spreader assembly. The intermediate spreader assembly is positioned below and adjacent to a knee engaging portion of the hammock body. The intermediate spreader assembly preferably includes at least two hollow members, with one hollow member extending longitudinally along the edge of the hammock directly adjacent each side edge of the hammock. Two cables extend along the sides of the hammock with one cable extending from the first vertical support member, through the head end of the hammock, through the foot end of the hammock, and connecting to a low point on the second vertical support member. The other one of each set of two cables extends from the first vertical support member, through the head end of the hammock, through the hollow member, up to the supplemental spreader bar and connects to a high point on the second vertical support member. Of the two cables that pass through the supplemental spreader bar, one passes through each end of the supplemental spreader bar. The assembly also includes a flexible spreader strap that extends transversely across the hammock body between raised side edges of the intermediate spreader, resiliently supporting an intermediate portion of the hammock. In some embodiments, the lateral tension on this strap is adjustable, preferably with a tie down ratchet or hook and loop fastener.

Another aspect of the invention is a set of traces or sleeves that extend along the sides of the hammock body. When the four cables are inserted through the traces, the hammock is both supported upwardly by the cables and has additional transverse tension exerted upon it. The tension caused by the cables serves to maintain the shape of the hammock when a person is lying in it.

In another embodiment of the invention, the hammock is supported by one cable on each side (rather than two cables per side). In this embodiment each cable extends from the first vertical support member, through the head end and side edges of the hammock, through the hollow member of the intermediate spreader assembly, through an end of the supplemental spreader bar, and connects to the second vertical support structure. The foot end of the hammock is connected to a spreader bar at the second end of the hammock, which is in turn suspended from a vertical support at the foot end to support the foot end at a relatively lower position to prevent reverse bending of the user's knees.

These and other aspects of the present invention will be more fully understood following a review of the detailed description and drawings.

DETAILED DESCRIPTION OF THE INVENTION

Figure 1:
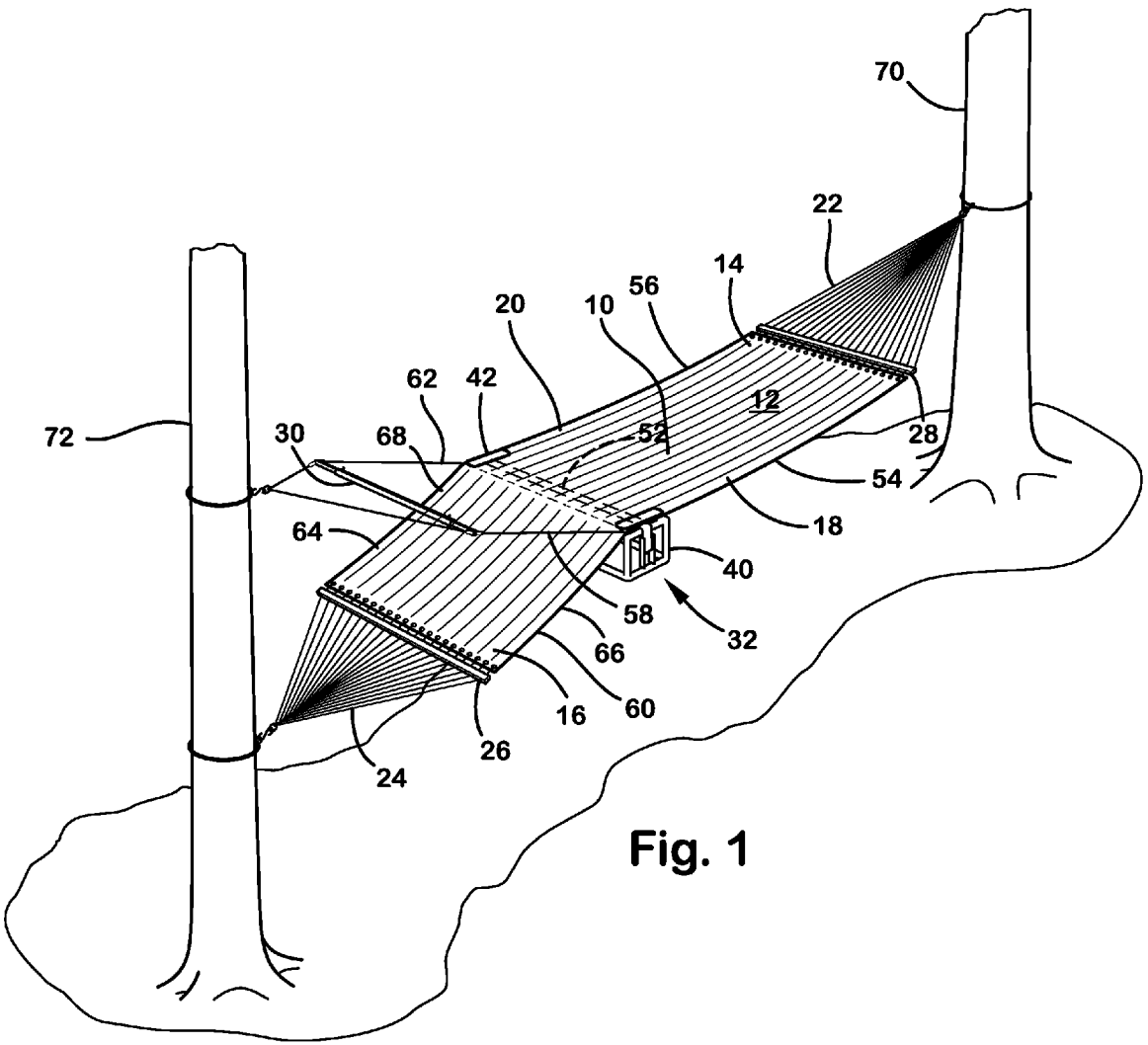
FIG. 1 is a perspective view of a hammock with intermediate support according to the invention.

Referring to FIG. 1, a perspective view of a first embodiment of the present invention is presented. A hammock 10 having a first or "head" end 14 and a second or "foot" end 16 is formed by a sheet of fabric 12. The sheet 12 is a generally elongated rectangular configuration and has parallel sides 18, 20, the sides being generally longer than the first and second ends 14, 16 of the hammock 10. It is contemplated that the fabric sheet 12 could be formed of cloth, woven threads, or line, as is known in the art. The hammock 10 is supported by two separated upright members 70, 72. Fanned rope sets 22 and 24 extend, one from each end of the hammock 10, to a respective one of the upright members 70, 72. The ropes could be traditional rope, cable, or other flexible support line.

In this embodiment, a rigid head end spreader bar 28 is attached to the first end of sheet 12 in a manner designed to maintain the hammock 10 in a general straight line at the head end 14 as a load (person) lies within the hammock. A foot end spreader bar 26 is attached to the second end of the sheet 12 to serve a like purpose.

In a conventional hammock according to the prior art, two spreader bars and their associated rope sets are hung at approximately the same height relative to the ground surface and provide the only support for the hammock body, so that the length of the hammock between the spreader bars forms a generally uninterrupted smooth concave curve along the longitudinal axis of the hammock.

In the present invention, the foot end 16 of the hammock 10 is desirably hung at a lower height than the head end 14. To achieve the height difference between the ends of the hammock 10, the foot end fanned rope set 24 can be attached to the upright support 72 at a lower position, or with a reduced tension or longer rope relative to the attachment of the head end fanned rope set 22 on the other upright support 70. As a result, the foot end 16 is positioned lower than it would be in a conventional hammock according to the prior art.

An intermediate spreader assembly 32 is provided at an intermediate position along the length of (and beneath) the hammock 10 in a position to provide an upward break in the uniform curve of the hammock body 12 corresponding to the approximate location of a user's knees. In this position, the spreader assembly 32 functions to support the knees and prevent hyperextension of the knees by removing upward force on the user's feet. In order to accomplish this, the intermediate spreader assembly 32 is also connected to the upright support 72 by upper side cable lines 58, 62 (discussed in more detail below).

Figure 2:
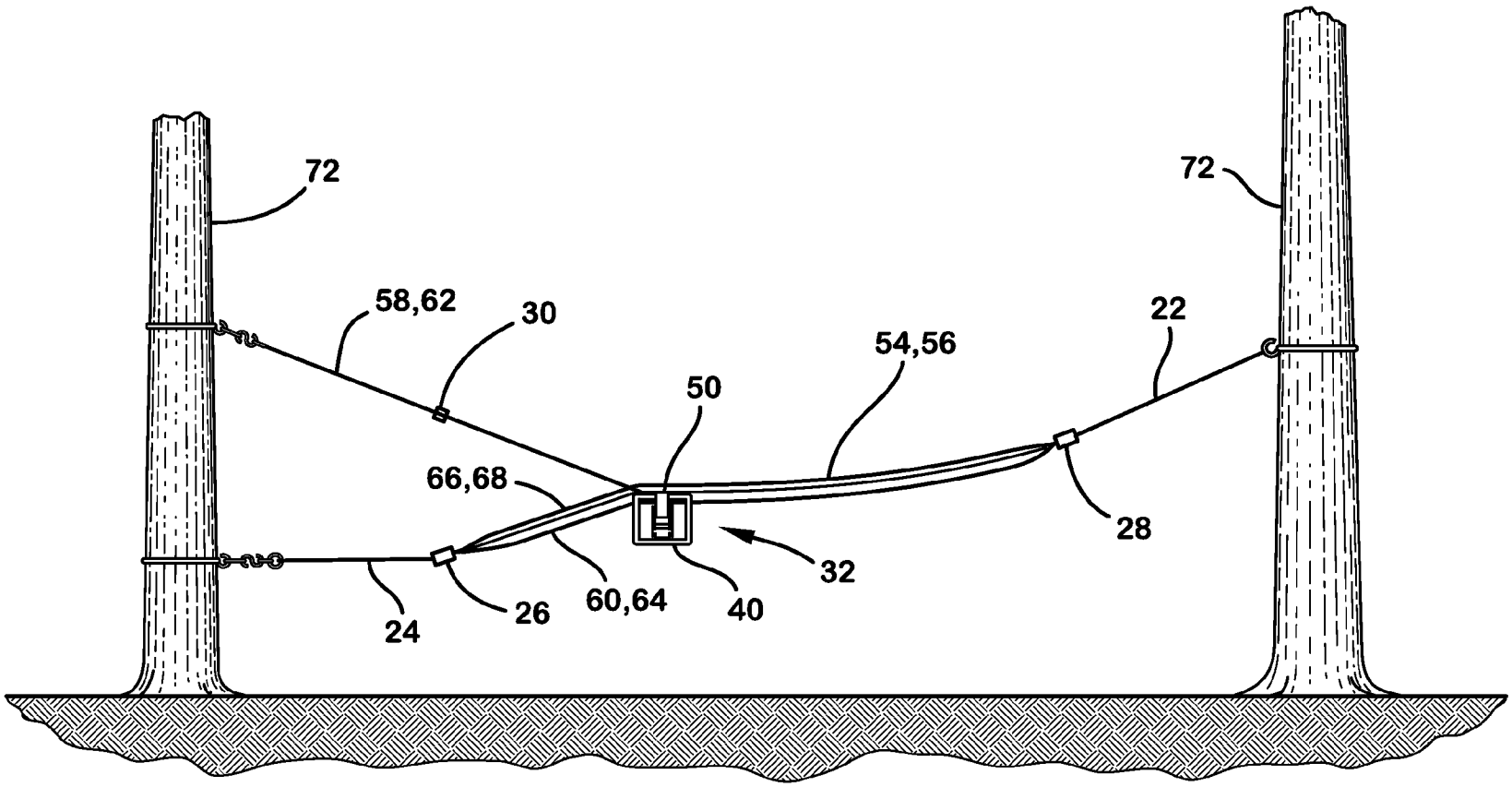
FIG. 2 is a side elevational view of the hammock of FIG. 1.

As shown in FIG. 2, the hammock 10 thus forms a uniform concave surface between the first spreader bar 28 and the intermediate spreader assembly 32, rather than between the first and second spreader bars 28, 26, as in the prior art. The portion of the hammock between the intermediate assembly 32 and the second spreader bar 26 hangs low enough so that the user's knees are not subjected to reverse bending pressure. Desirably, the second spreader bar 26 is positioned below the top of the intermediate spreader assembly 32, forming a break in the arc of the hammock material 12 so that the user's knees can bend at the position of the intermediate spreader assembly 32.

A further feature of this embodiment of the invention is the inclusion of cable traces or sleeves 54, 56, 66, 68 in the side edges 18, 20 of the hammock fabric 12. Two side cables extend through each of the upper sleeves 54, 56 and one side cable extends through each of lower sleeves 66, 68. Specifically, an upper side cable 58 and lower side cable 60 extend adjacently along side 18 of hammock body 12, from upright support 70, through one end of the head end spreader bar 28, through an upper side trace 54. At the far end of upper side trace 54, the upper cable 58 passes through intermediate spreader 32 and then diverges from lower cable 60. Upper cable 58 then extends upwardly through one end of a supplemental spreader bar 30 and connects to upright support 72. The lower side cable 60, in contrast, passes out of upper side trace 54, extends through spreader assembly 26, and then extends through the lower side trace 66, through one end of the foot end spreader bar 26, and connects to upright support 72 (at a lower position than upper cable 58). Likewise, a corresponding upper side cable 62 and lower side cable 64 on the opposite side edge of the hammock extend through corresponding paths from upright support 70, through a second end of head end spreader bar 28 and through upper side trace 56, and intermediate support 32. The cables diverge thereafter, with upper cable 62 passing out of trace 56, through spreader assembly 32, and extending back upwardly through the second end of supplemental spreader bar 30, and connecting to upright support 72. Lower side cable 64 extends through lower side trace 68 through the intermediate spreader, and then through the second end of the foot end spreader bar 26, and connecting to upright support 72 (at a lower position than upper cable 62). All four cables 58, 60, 62, 64 are under tension. In addition to aiding in maintaining the relative heights of the of the ends and middle of the hammock 10, these cables also serves to maintain the desired transverse tension in the fabric 12 to provide support to the user, and to prevent the edges of the hammock fabric from collapsing transversely inwardly. The cable traces serve as guide tubes for the cables. However, they also serve to hold the intermediate spreader at its desired longitudinal position on the assembly.

While the inclusion of lower side cables 60, 64 is preferred, they are not necessary for the functioning of the invention. In such a case, the fabric of the hammock provides the tension resistance supplied by the lower side cables. In such a case, the lower side traces 66, 68 are not needed as cable conductors.

The supplemental spreader bar 30 is positioned between upper side cables 58 and 62 in an orientation that is transverse to the body 12 of the hammock 10 and generally parallel to the other two spreader bars 26 and 28. This bar 30 serves to maintain a wider space for the user's body to fit between cables 58 and 62.

Figure 3:
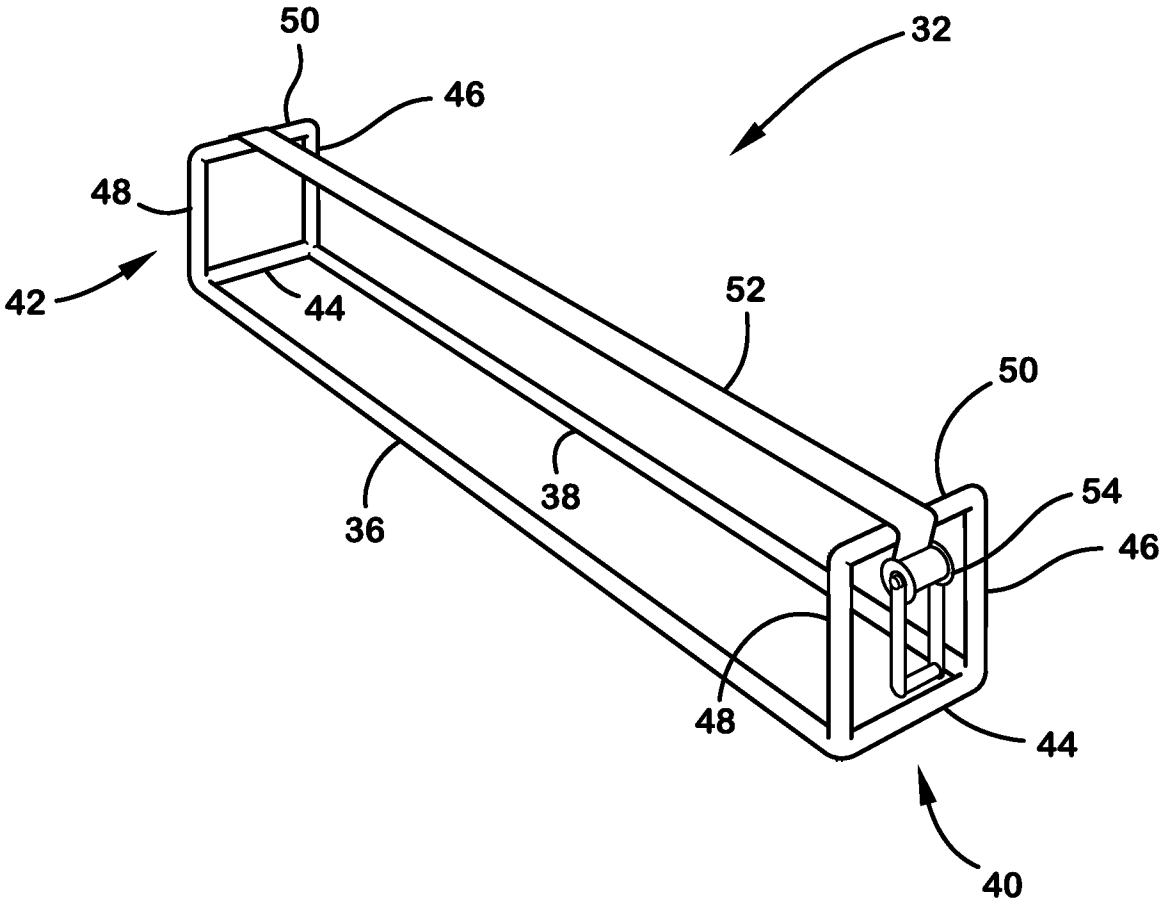
FIG. 3 is a perspective view of an intermediate spreader assembly according to the invention.

Referring now to FIG. 3, a perspective view of the intermediate spreader assembly 32 of the present invention is shown in isolation. The spreader assembly 32 includes a spreader box 34 and flexible spreader strap 52. The spreader box 34 is a symmetrical support structure constructed of a framework of rigid members, for example, PVC pipes. The box 34 includes a rigid square 40, 42 on each end. Each square 40, 42 is formed of two spaced upright members 46 and 48 connected at their ends to lower cross member 44 and upper cross member 50. Each of the upper cross members 50 is preferably hollow so as to allow the side cables 58, 62 to extend through the spreader assembly 32, as discussed above. Extending transversely beneath the hammock body 12 between corresponding bottom corners of upright members 46 and 48 are a pair of rigid transverse members 36, 38. These members 36, 38 maintain the proper distance between the two ends 46, 48 of box 34.

A flexible spreader strap 52 extends between the upper members 50 of ends 40 and 42. The strap 52 is preferably formed of nylon, canvas or other flexible material having good tensile strength with minimal stretching. The strap 52 is positioned transversely directly under the hammock surface 12 to support the surface and provide a "break" point in the curvature of the hammock 10. The strap also thus forms a wide, non-rigid positive support in the proper position for the user's knees. In one embodiment, the tightness of the strap 52 is adjustable by the user using tie down ratchet 54.

The spreader assembly 32 provides additional transverse support for the hammock fabric 12 at the intermediate position, serving to keep the edges of the fabric spread apart to reduce the transverse curvature of the hammock fabric, as it would otherwise sag more inwardly in the absence of the spreader assembly 32.

A hammock with intermediate support has been described in this disclosure in various exemplary embodiments, but it will be understood by those having ordinary skill in this art that the disclosed invention is not limited by this description. Various modifications and variations of the described embodiments may be made without departing from the scope of this invention.

What is claimed is:

1. A hammock comprising:

a bed of fabric having first and second ends, and sides;

one or more elongated tension members connecting the first end to a first vertical support member and one or more elongated tension members connecting the second end to a second vertical support member;

an intermediate support supporting the bed of fabric at a knee position between the first and second ends, and being suspended between the first and second support members, the intermediate support providing elevated knee support to a user so as to protect the knee from backward bending force on the knee due to downward curvature of the hammock, the intermediate support being connected between the first end and the intermediate support on at least one end of the hammock by at least cables running through sleeves in each edge of the bed of fabric, the intermediate support being connected to the second support by flexible elongated tension members interconnecting the intermediate support with the second support.

2. The hammock of claim 1, wherein the second end of the hammock is connected to the second support so as to position the second end lower than the intermediate support.

3. A hammock comprising:

an elongated bed formed of flexible material having head and foot ends and sides;

substantially rigid head and foot end spreader bars attached respectively to the head and foot ends of the bed;

an intermediate bed support positioned under the bed at an intermediate position between the head and foot end spreader bars, the intermediate position being such that the intermediate bed support is positioned generally under the knees of a person using the hammock;

flexible, elongated head and foot spreader bar tension members attached respectively to the head and foot spreader bars, head tension members having outer ends that are attached to a head end vertical support at a first elevation, foot tension members having outer ends that are attached to a foot end vertical support at a second elevation, the intermediate bed support being suspended between the vertical supports by tension members at a third elevation, the first, second and third elevations being such that the third elevation is higher than the second elevation, such that the intermediate bed support maintains the knees of a hammock occupant at an elevated position that resists a reverse flexing of the occupant's knees when the occupant is resting on the hammock with his knees positioned over the intermediate bed support.

4. A hammock according to claim 3 wherein the support members maintain the head end spreader bar at a first elevation, the foot end spreader bar at a second elevation lower than the first elevation, and the intermediate bed support at a third elevation higher than the second elevation but lower than the first elevation.

5. A hammock according to claim 4 wherein the hammock includes a flexible strap adjustment mechanism on the intermediate spreader frame for adjusting the tension on the flexible strap across the intermediate spreader to change the elevation of the strap extending across the intermediate spreader.

6. A hammock according to claim 3 wherein the elongated frame of the intermediate bed support comprises a flexible transverse strap that engages the underside of the hammock and a substantially rigid intermediate spreader frame that supports the strap at a position spaced above the rigid spreader frame such that the knees of the hammock occupant are suspended on the strap above the rigid spreader frame and do not engage the rigid spreader frame.

7. A hammock according to claim 6 wherein the intermediate spreader frame comprises a pair of spaced transverse members, lower cross members extending between ends of the transverse members holding the transverse members in this spaced position, upright rails extending upwardly from ends of the transverse members, and upper cross members extending between upper ends of the upright rails, the flexible strap being attached to and suspended between the upper cross members on opposite sides of the intermediate spreader frame.

* * * * *